US008627973B2

(12) United States Patent
Dekkers

(10) Patent No.: US 8,627,973 B2
(45) **Date of Patent: *Jan. 14, 2014**

(54) CONTAINER COMPRISING A COLLAPSIBLE SIDEWALL

(75) Inventor: Hendrik Dekkers, RM Zwolle (NL)

(73) Assignee: IFCO Systems GmbH, Pullach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/273,535

(22) Filed: Oct. 14, 2011

(65) Prior Publication Data

US 2012/0181271 A1 Jul. 19, 2012

Related U.S. Application Data

(63) Continuation of application No. PCT/EP2009/002760, filed on Apr. 15, 2009.

(51) Int. Cl.
*B65D 6/18* (2006.01)
*B65D 8/14* (2006.01)

(52) U.S. Cl.
USPC ..... 220/6; 220/7; 220/676; 220/666; 220/600; 220/4.28

(58) Field of Classification Search
USPC ..... 220/4.01, 4.28, 4.33, 6, 600, 666, 7; 206/600
IPC ..... B65D 6/18,6/22
See application file for complete search history.

(56) References Cited

U.S. PATENT DOCUMENTS

| | | | | |
|---|---|---|---|---|
| 4,081,099 | A | 3/1978 | Shead | |
| 5,094,356 | A * | 3/1992 | Miller | 220/7 |
| 5,398,834 | A | 3/1995 | Umiker | |
| 5,829,617 | A | 11/1998 | Umiker | |
| 5,967,356 | A | 10/1999 | Laarhoven et al. | |
| 6,015,056 | A | 1/2000 | Overholt et al. | |
| 6,286,701 | B1 * | 9/2001 | Umiker | 220/6 |
| 6,290,081 | B1 | 9/2001 | Merey | |
| 6,386,388 | B1 | 5/2002 | Overholt | |
| 6,460,717 | B1 * | 10/2002 | Smyers et al. | 220/6 |
| 6,820,761 | B1 | 11/2004 | Mouri et al. | |
| 7,011,225 | B2 | 3/2006 | Oster et al. | |
| 7,017,766 | B2 | 3/2006 | Hsu et al. | |
| 7,048,135 | B2 | 5/2006 | Smyers et al. | |
| 7,100,786 | B2 | 9/2006 | Smyers | |
| 7,128,231 | B2 * | 10/2006 | Overholt | 220/4.28 |
| 7,159,730 | B2 | 1/2007 | Rumpel et al. | |
| 2002/0108950 | A1 | 8/2002 | Moorman et al. | |
| 2003/0116564 | A1 | 6/2003 | Overholt et al. | |

(Continued)

FOREIGN PATENT DOCUMENTS

| | | |
|---|---|---|
| AT | 009832 | 1/2007 |
| CN | 1730353 | 2/2006 |

(Continued)

*Primary Examiner* — Mickey Yu

*Assistant Examiner* — Brijesh V. Patel

(74) *Attorney, Agent, or Firm* — Michael A. Glenn; Perkins Coie LLP

(57) ABSTRACT

The present invention relates to a container comprising foldable sidewalls which has a hinge connection which almost entirely prevents the base from slumping relative to the sidewall even under load, The container may be produced in a particularly simple and inexpensive manner, since due to the specific hinge connection, the base may be produced, in an injection-molding process, without any slide in the tool, and since a simple tool arrangement is thus enabled.

7 Claims, 16 Drawing Sheets

(56) References Cited

U.S. PATENT DOCUMENTS

| | | | | |
|---|---|---|---|---|
| 2003/0132228 | A1* | 7/2003 | Apps et al. | 220/6 |
| 2003/0146213 | A1 | 8/2003 | Kellerer et al. | |
| 2004/0099662 | A1 | 5/2004 | Overholt | |
| 2004/0129700 | A1 | 7/2004 | Oster et al. | |
| 2004/0178197 | A1 | 9/2004 | Hsu et al. | |
| 2004/0182858 | A1* | 9/2004 | Smyers | 220/6 |
| 2006/0231555 | A1 | 10/2006 | Smyers | |
| 2007/0145053 | A1 | 6/2007 | Gil | |
| 2008/0169285 | A1* | 7/2008 | Marazita et al. | 220/7 |
| 2008/0302791 | A1 | 12/2008 | Baltz et al. | |
| 2011/0259884 | A1* | 10/2011 | Kellerer et al. | 220/6 |
| 2011/0272400 | A1* | 11/2011 | Huizingh | 220/6 |
| 2012/0118883 | A1* | 5/2012 | Orgeldinger | 220/6 |
| 2012/0118884 | A1* | 5/2012 | Orgeldinger | 220/7 |
| 2012/0152947 | A1* | 6/2012 | Orgeldinger | 220/7 |
| 2013/0048652 | A1 | 2/2013 | Orgeldinger | |

FOREIGN PATENT DOCUMENTS

| | | | |
|---|---|---|---|
| CN | 101374729 | | 2/2009 |
| DE | 19623690 | A1 | 6/1996 |
| DE | 10137328 | B4 | 7/2001 |
| DE | 20210106 | | 6/2002 |
| DE | 202004016511 | | 10/2004 |
| EP | 1114779 | A2 | 7/2001 |
| EP | 1647492 | A1 | 4/2006 |
| EP | 1655232 | | 5/2006 |
| EP | 1840038 | A1 * | 10/2007 |
| EP | 2036825 | | 3/2009 |
| ES | 2285290 | | 7/2004 |
| FR | 2408979 | | 6/1979 |
| GB | 2425303 | B | 4/2006 |
| GB | 2452750 | A | 9/2007 |
| GB | 2443949 | | 5/2008 |
| JP | H10506868 | | 7/1998 |
| JP | 2002362549 | | 12/2002 |
| JP | 2003518471 | | 6/2003 |
| JP | 2003312659 | | 11/2003 |
| JP | 2004018004 | | 1/2004 |
| JP | 2004262540 | | 9/2004 |
| JP | 2004323095 | | 11/2004 |
| JP | 2005022667 | | 1/2005 |
| JP | 2007168822 | | 7/2005 |
| JP | 2005231723 | | 9/2005 |
| JP | 2007168821 | | 7/2007 |
| JP | 2007176562 | | 7/2007 |
| JP | 2007217002 | | 8/2007 |
| JP | 2009029484 | | 2/2009 |
| JP | 2009255932 | | 11/2009 |
| WO | WO-96/11144 | | 4/1996 |
| WO | WO-9637410 | | 11/1996 |
| WO | WO-98/34838 | | 8/1998 |
| WO | WO-00/63084 | | 10/2000 |
| WO | WO-0147778 | | 7/2001 |
| WO | WO-03053799 | | 7/2003 |
| WO | WO-2005016770 | | 2/2005 |

* cited by examiner

CONTAINER COMPRISING A COLLAPSIBLE SIDEWALL

CROSS-REFERENCE TO RELATED APPLICATIONS

This application is a continuation of copending International Application No. PCT/EP2009/002760, filed Apr. 15, 2009, which is incorporated herein by reference in its entirety.

BACKGROUND OF THE INVENTION

The present invention relates to a container as claimed in the preamble of claim 1.

Such containers are known in manifold ways. For example, there are containers having four sidewalls, all of which are arranged, by means of hinges, such that they can be folded onto the base of the container. Alternatively, containers are known wherein the short sides are typically folded upward and away from the container base, and the long sides, in turn, may be folded onto the base via a hinge connection. At the same time, an upper circumferential frame is thereby lowered onto the container base.

In this manner, the height of the container may be reduced, so that after using the container, considerably reduced floor space is needed for return transport or storage of the container.

The hinges used are mostly joint hinges, wherein hinge pins are received within orifices of the container base, or the sidewalls are fastened to the container base by means of integrally formed film hinges. Such film hinges are easy to clean and enable simple manufacturing. Joint hinges, in contrast, may easily be detached from the base, so that sidewalls may be replaced in the case of damage, and so that repairing the containers is possible.

A container comprising hinged sidewalls, wherein hinges arranged on the sidewall are placed into corresponding orifices in the container base and are locked there, are already known from U.S. Pat. No. 5,094,356 A. A stop cooperating with the hinge pin and being formed in the container base is to protect the hinge connection against impacts from outside.

A hinge connection wherein the hinge pin is enclosed by a rotating hinge sleeve is known, in turn, from U.S. Pat. No. 4,081,099 A. The hinge sleeve has a catch lug formed thereon which impinges on a stop when the sidewall is upright, so as to prevent further outward rotation of the sidewall beyond the vertical position.

A further implementation is shown in EP 0 958 177 B1, on which the present invention is based in accordance with the preamble of claim 1. In this implementation, the hinge pin is held within the hinge orifice of the container base by means of catch springs, the catch springs being implemented to be flexible, so that clamp-like insertion or removal of the hinge pin is possible. What is disadvantageous about this implementation is that this connection exhibits no high resistance against the upright sidewall being pulled out when the container is loaded. Due to the flexibility of the catch springs, the rim of the base may slump under load, and a sharp bend is obtained between the rim of the base and the sidewall, which has a negative impact on the load application.

SUMMARY

According to an embodiment c container, in particular for transporting fruit and vegetables, may have a container base and at least two sidewalls that are foldable onto the container base, the foldable sidewalls being articulated relative to the base by means of hinges, and the hinges comprising a hinge pin which in an upright position of the foldable sidewall is held, within an orifice in the container base that corresponds to the hinge pin, against being pulled out from the orifice, at least one catch lug which unilaterally protrudes in the direction transverse to the alignment of the hinge pin being configured on the hinge pin, wherein in the folded-open position of the sidewall, the hinge pin is held within the orifice by at least one protrusion, the catch lug fixing the hinge pin within the orifice underneath the protrusion.

The inventive container, which is used, in particular, for transporting fruit and vegetables, comprises a container base and at least two sidewalls that are foldable onto the container base, the foldable sidewalls being articulated relative to the base by means of hinges, and the hinges comprising a hinge pin which in an upright position of the foldable sidewall is held, within an orifice in the container base that corresponds to the hinge pin, against being pulled out from the orifice, at least one catch lug which unilaterally protrudes in the direction transverse to the alignment of the hinge pin being configured on the hinge pin. In addition, provision is made for the hinge pin to be held, in the folded-open position of the sidewall, within the orifice by at least one protrusion, the catch lug fixing the hinge pin within the orifice underneath the protrusion.

As compared to the known hinge connection of EP 0 958 177 B1, the catch lug is thus not used for protecting the sidewall from folding open beyond the upright position, but in connection with the protrusion, the catch lug replaces what has so far been the resilient lock of the hinge pin, so that the hinge pin may be protected in a very stable manner from being removed from the orifice. Thus, the catch lug acts against the wall of the orifice, so that the hinge pin is fixed underneath the protrusion.

In this manner, the base is very effectively prevented from bending in relation to the sidewall. By means of the unilaterally projecting catch lug, the hinge pin within the orifice may advantageously perform an eccentric movement during folding, and in this matter, care can to be taken to ensure, in particular, that the hinge pin is introducible into the orifice in a position past the protrusion and is located underneath the protrusion in a position that is folded by 90°.

Expediently, at least one insertion lug is provided, within the orifice, for clamp-like reception of the hinge pin within the orifice. In this manner, it is ensured that the hinge pin may be readily inserted into and removed from the orifice, so that sidewalls may be readily replaced. In addition, the insertion lugs protect the sidewall, in the folded-down state, from unwanted removal of the hinge pin from the orifice.

Particularly, the catch lug is advantageously integrally formed on the hinge pin, specifically in the orientation vertical to the extension of the sidewall, so that the hinge is removable from the orifice when the sidewall is folded onto the container base.

Particularly expediently, the hinge pin is centrally attached on the sidewall by means of at least one ridge, and one, better two pairs of opposite and counteracting insertion lugs are formed, within the orifice, on either side of the ridge(s). In this manner, a particularly stable hinge connection is realized.

In a particularly advantageous implementation, the protrusion holding the hinge pin is formed underneath at least two adjacent insertion lugs. In this case, the hinge connection is configured to be particularly compact, and because of the adjacent protrusions, the hinge pin is stably held within the orifice without being able to tilt.

Expediently, the sidewall comprises at least one support which cooperates with the base and forms, in the upright position of the sidewall, a mechanical barrier against the sidewall folding open further. In this case, overexpansion of the folding-open may be effectively prevented, so that the opened container gains additional stability.

The support may be formed as a catch lug which, in the upright position of the sidewall, engages behind a protrusion or recess in the base. Alternatively or additionally, the support may be configured as a surface element which, in the upright position of the sidewall, adjoins a corresponding area element of the base, the area elements being protected, in an upright position of the sidewall, from mutual displacement in the normal direction of the area elements, and the two area elements extending in the direction of the extension of the upright sidewall. The implementation of the area elements is advantageous, however, since it ensures increased load suspension, and thus, increased stability.

BRIEF DESCRIPTION OF THE DRAWINGS

The features and further advantages will become apparent from the description of an embodiment with reference to the drawing, wherein.

DETAILED DESCRIPTION OF THE INVENTION

Figure 1:
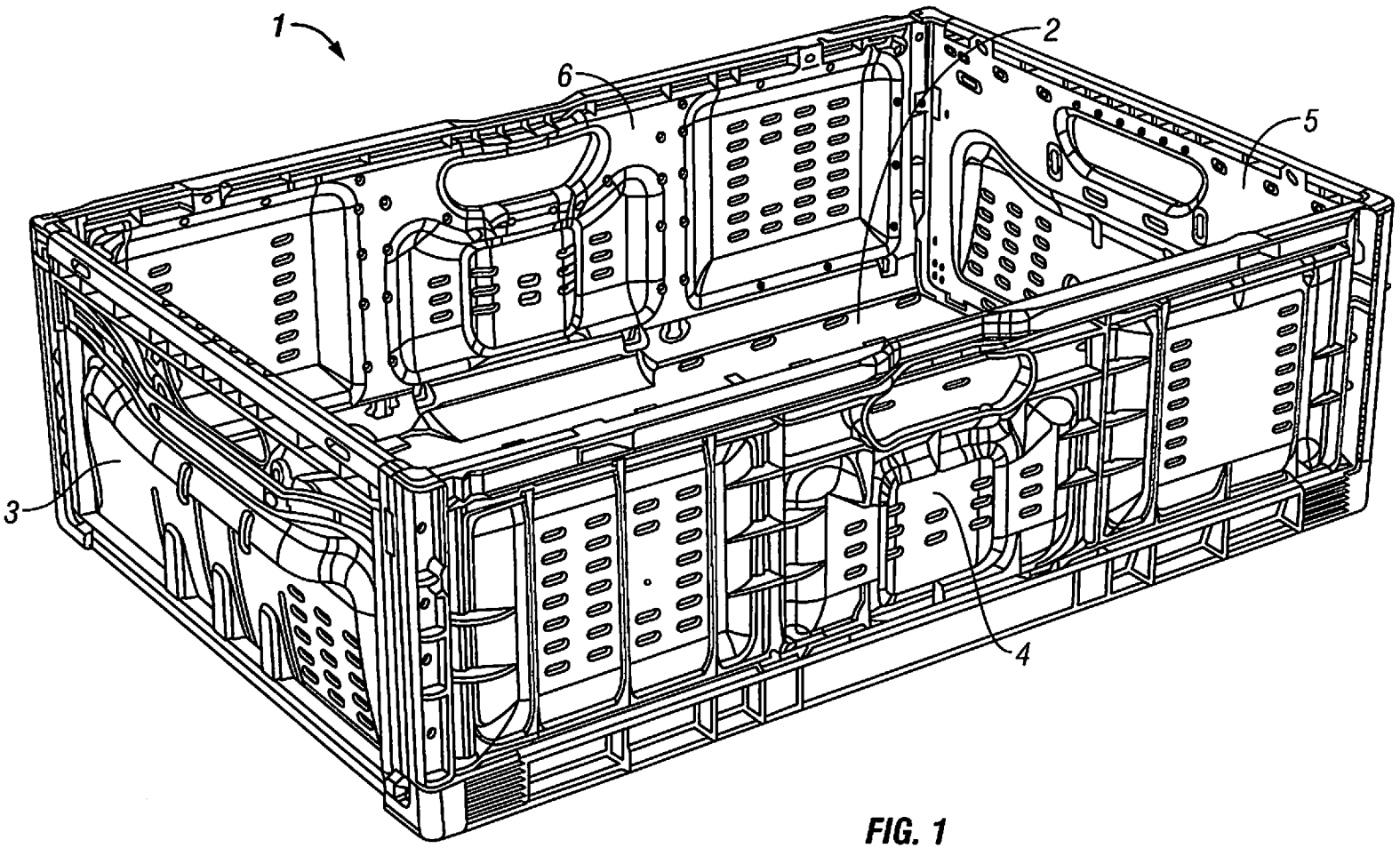
FIG. 1 shows the inventive container in a perspective overall view.

In FIG. 1, the inventive container 1, which was produced from plastic in an injection-molding process, is depicted merely schematically in an overall view. It can be seen that the container 1 comprises a container base 2 and four sidewalls 3, 4, 5, 6 arranged thereon. It can be recognized, from the section through the container 1, which is parallel to the container base 2 and is shown in a purely schematic manner, that the short sidewalls 3, 5 are connected to the container base 2 by means of three hinge connections 7, respectively, and that the long sidewalls 4, 6 are connected to the container base 2 by means of four hinge connections 7, respectively.

Due to the hinge connections 7, the sidewalls 3, 4, 5, 6 each may be folded down onto the container base 2 in a known manner, so that the container 1 is considerably reduced in height. The articulation points of the hinge connections 7 with regard to the short sidewalls 3, 5 are located at a level with the container base 2, whereas the articulation points of the hinge connections 7 of the long sidewalls 4, 6 are arranged to be offset by at least one wall thickness in relation to the container base 2, so that the long sidewalls 4, 6 come to lie flat on top of one other in the folded-up state. In the embodiment depicted, the articulation point is arranged at such a height, and offset in relation to the base-side bearing surface, that the long sidewalls come to lie flat, without any mutual overlap, on the short sidewalls that are already folded down onto the base.

Figure 2:
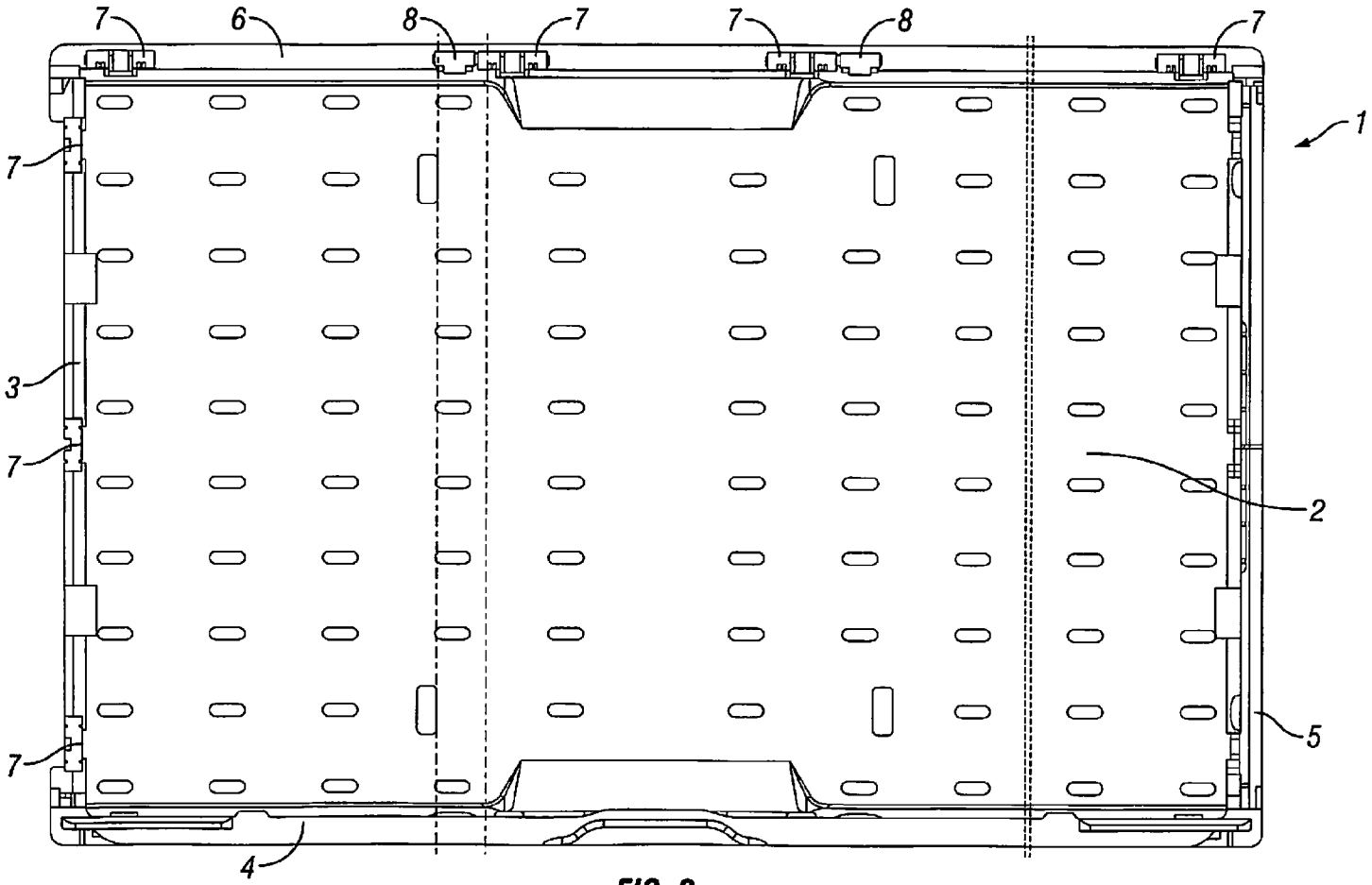
FIG. 2 shows a section, in parallel with the container base, through the inventive container of FIG. 1, FIGS. 3*a* to 3*c* show sections through the hinge connection of the inventive container of FIG. 1 in three different positions, the container being depicted with the base at the top.

In addition, one may recognize in FIG. 2 that in addition to the hinge connections 7, supports 8 between the long sidewalls 4, 6 and the container base 2 are provided.

Figure 3A:
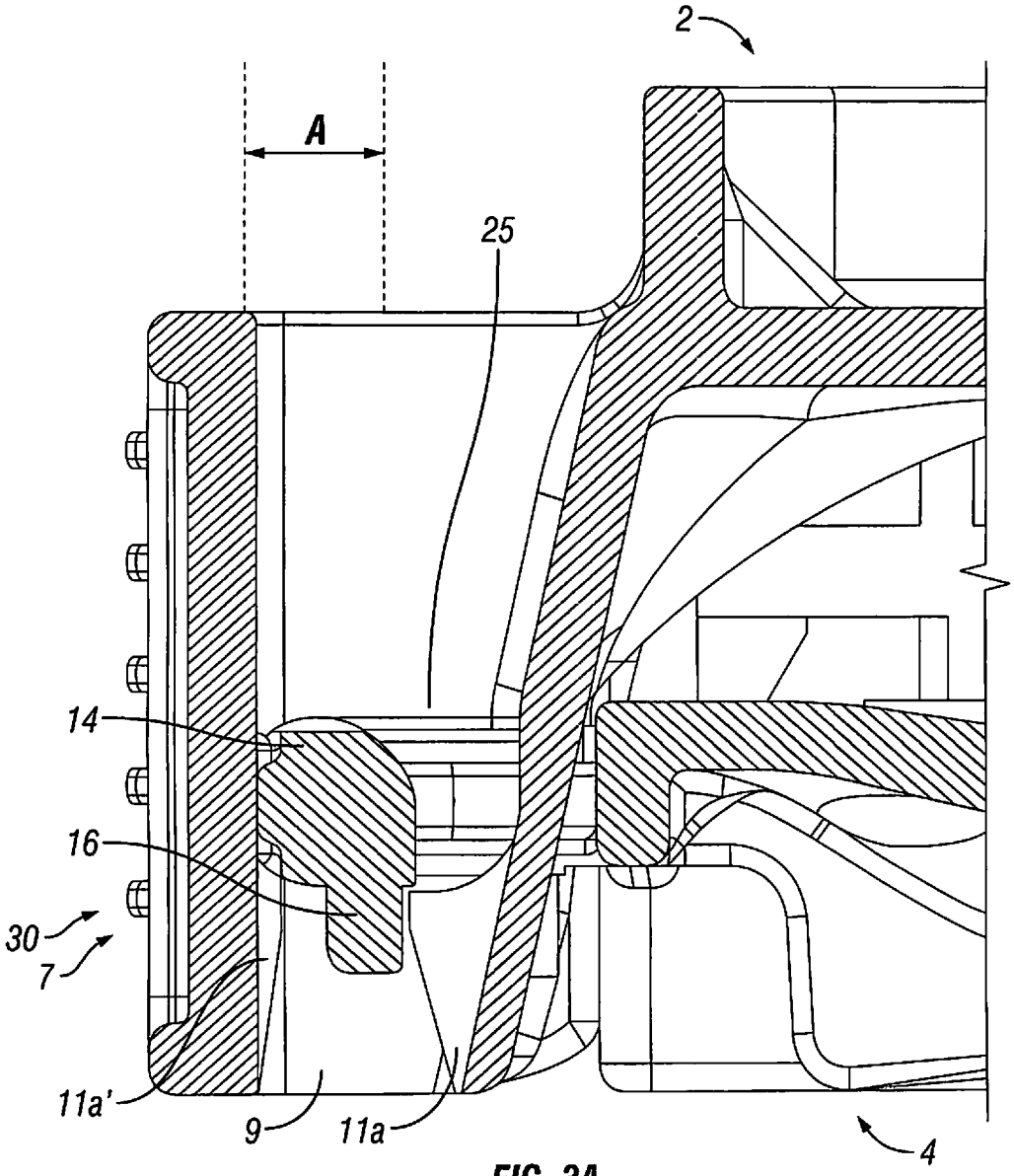
Figure 3B:
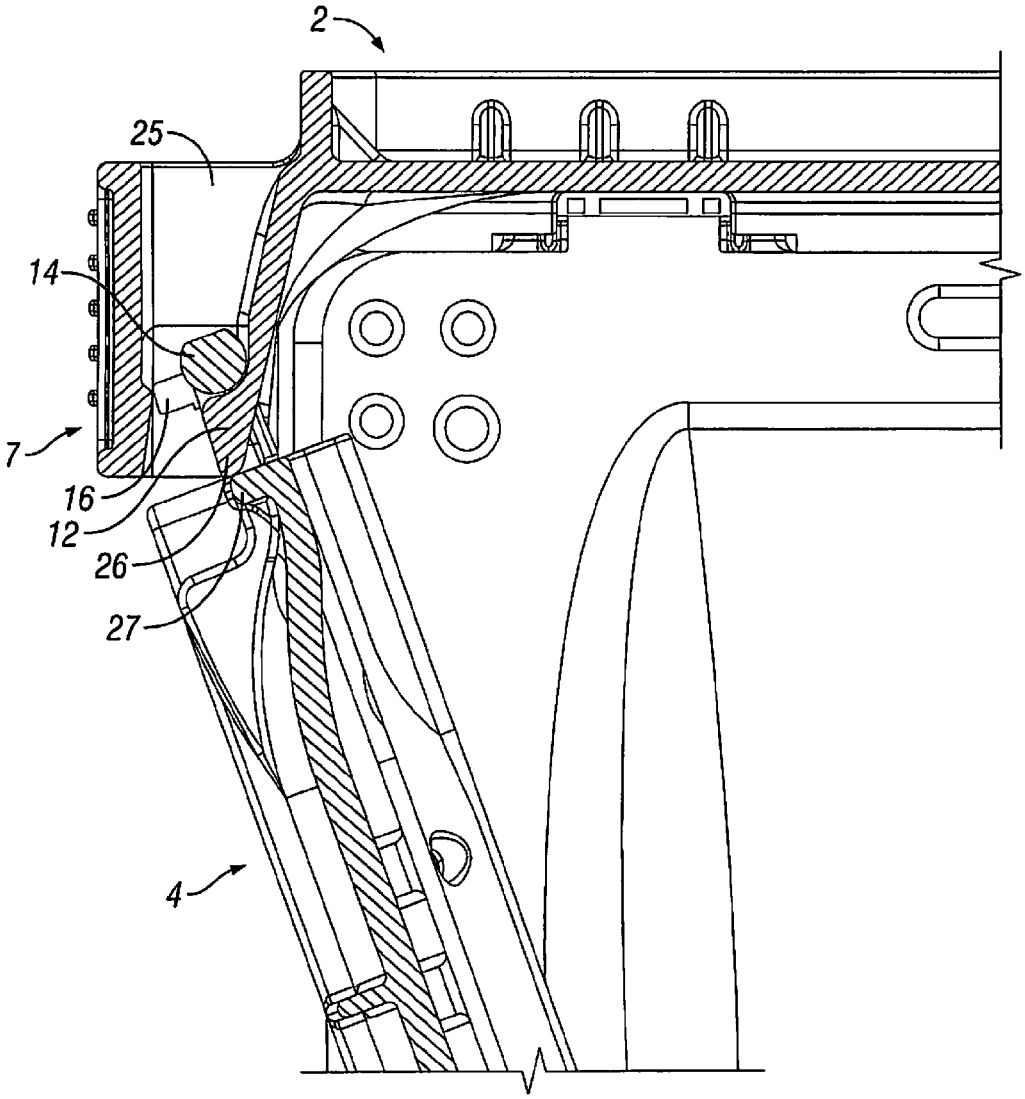
Figure 3C:
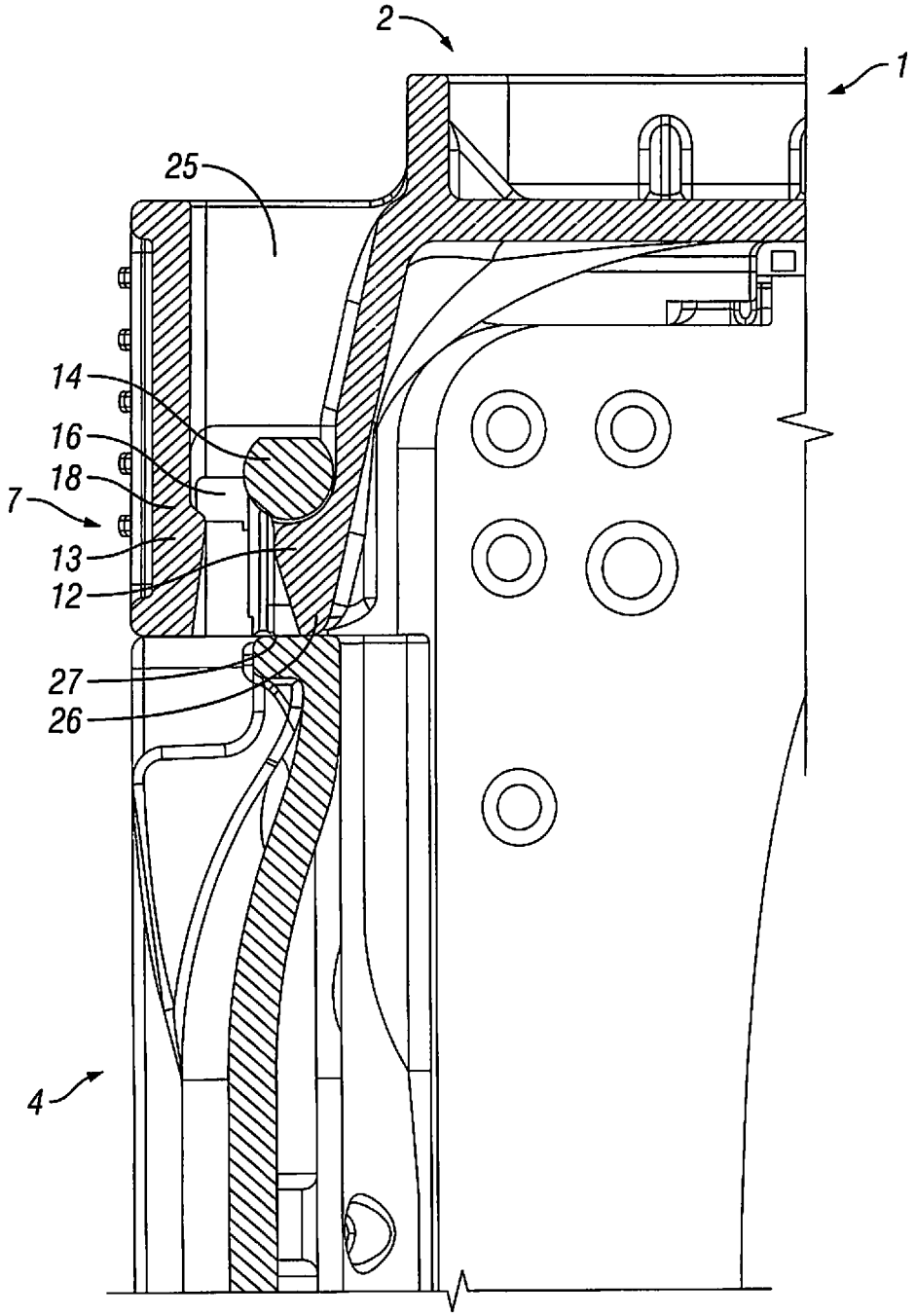
Figure 4A:
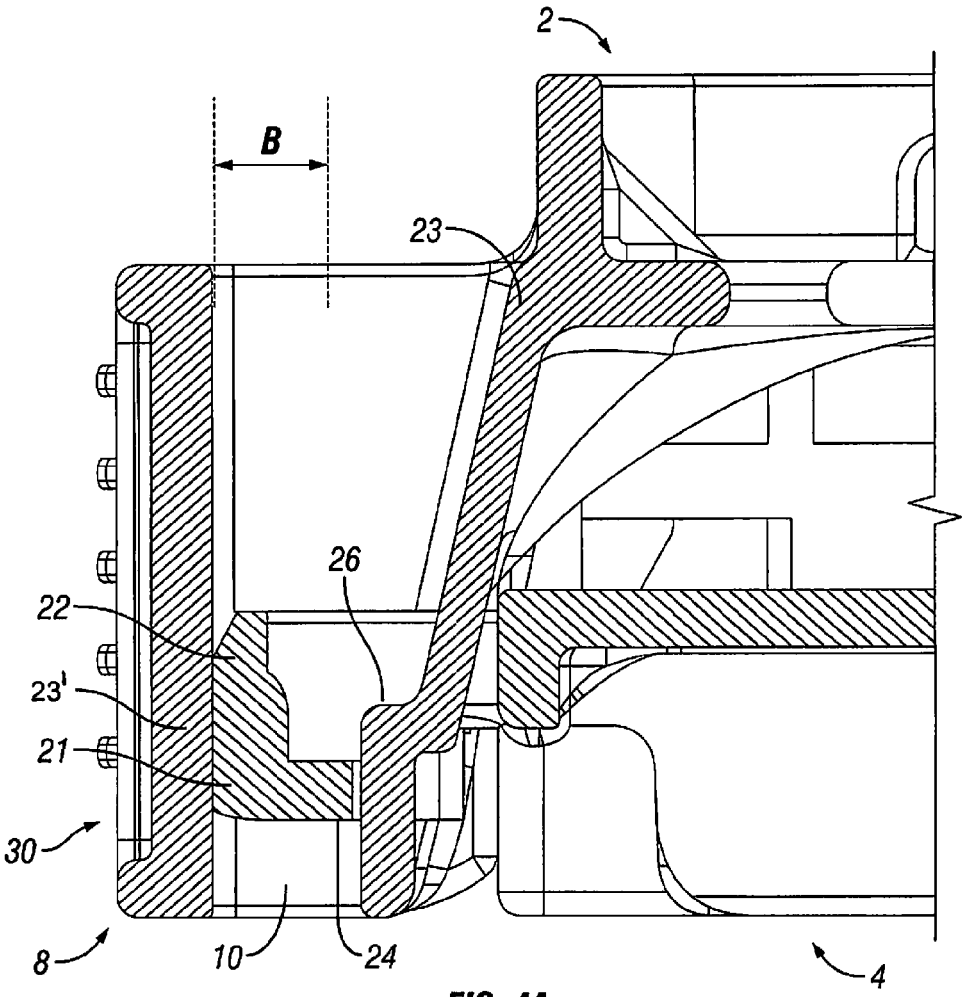
FIGS. 4*a* to 4*c* show sections through the support of the inventive container of FIG. 1 in three different positions, the container being depicted with the base in the top position, by analogy with FIGS. 3*a* to 3*c*, FIGS. 5 and 6 show detailed representations of the base of the inventive container of FIG. 1 from two perspectives.
Figure 4B:
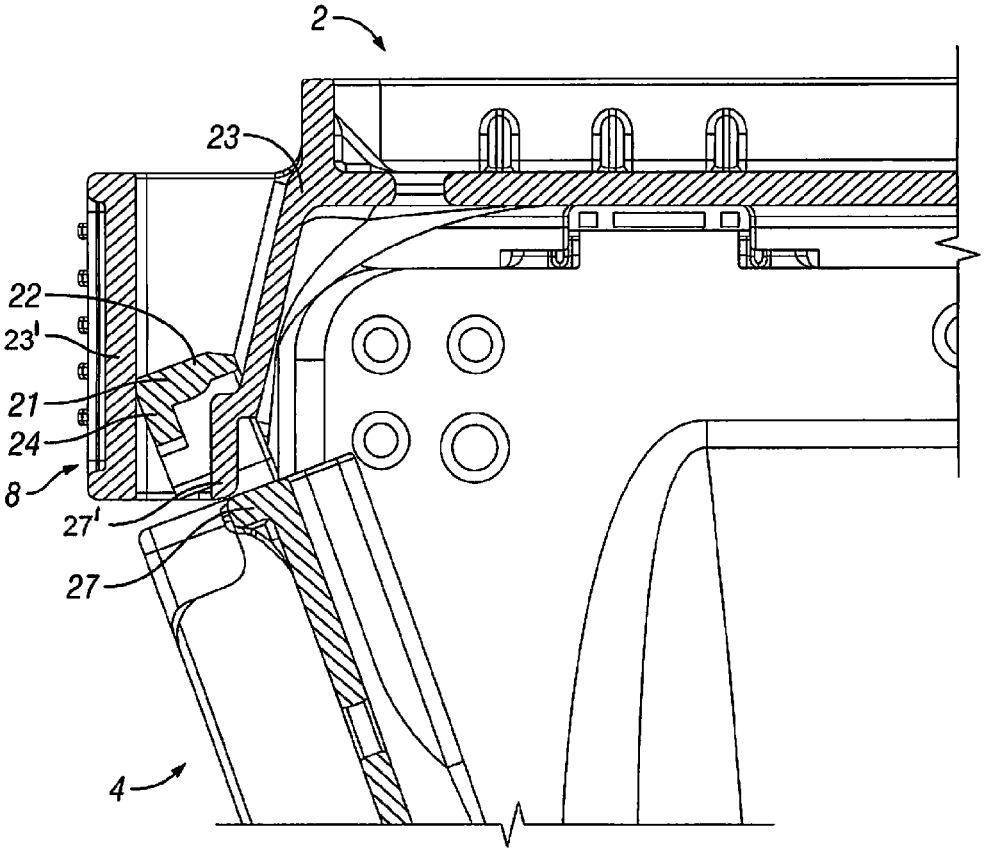
Figure 4C:
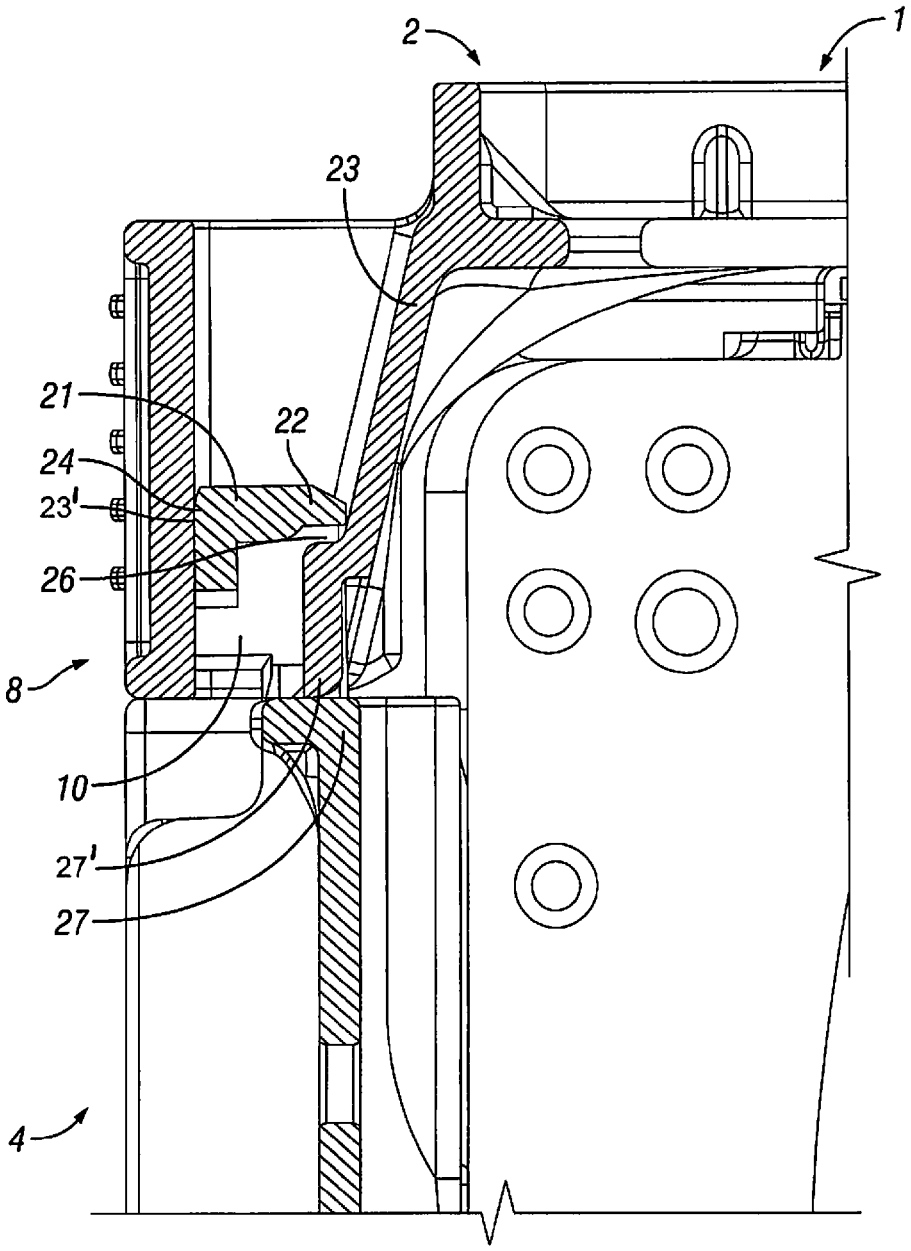
Figure 5:
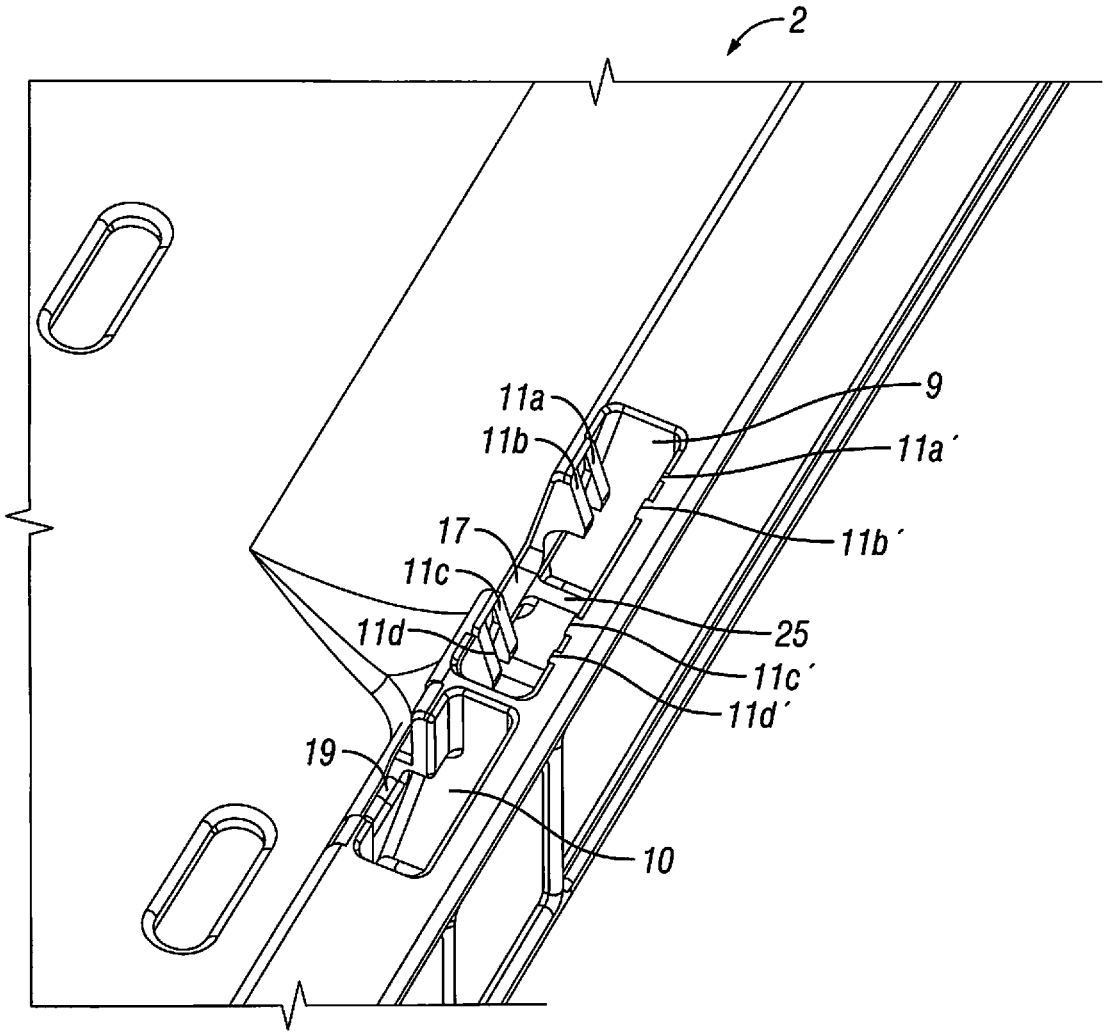
Figure 6:
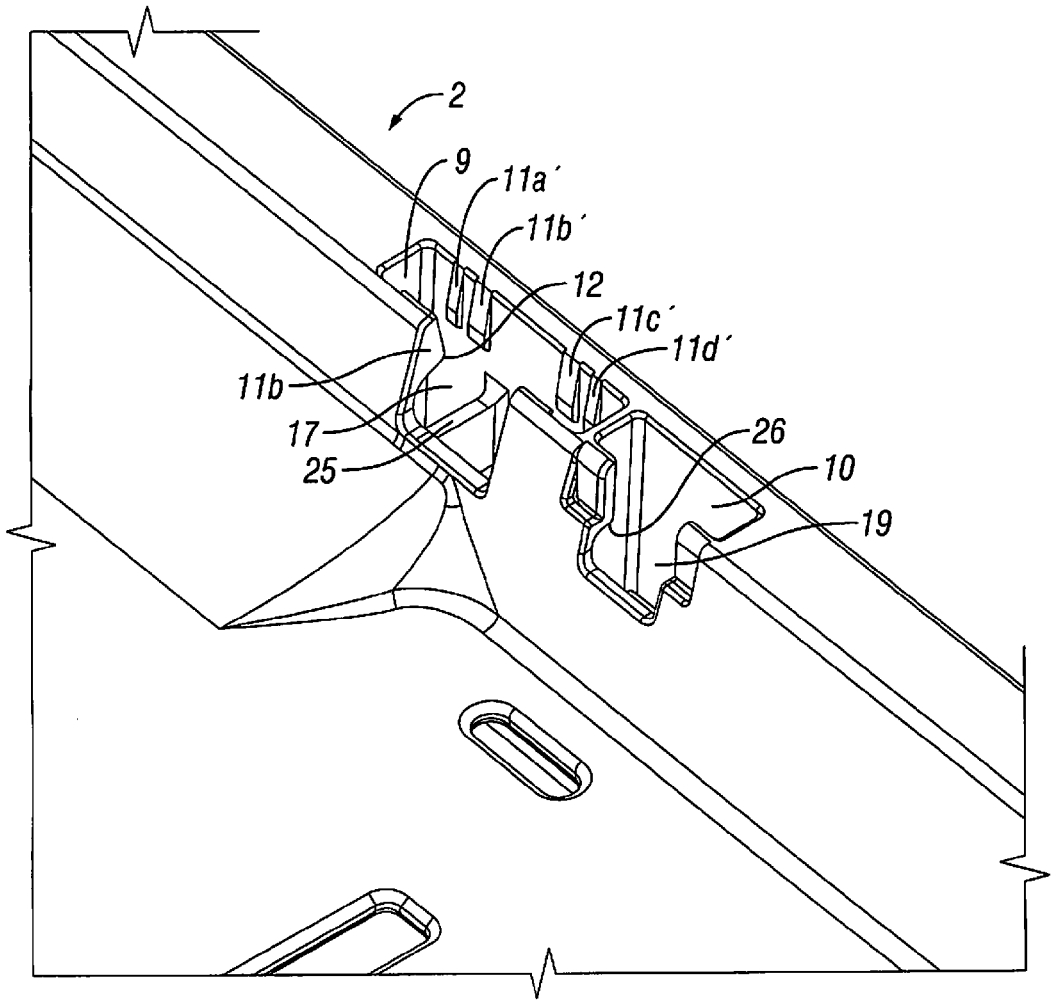
Figure 7:
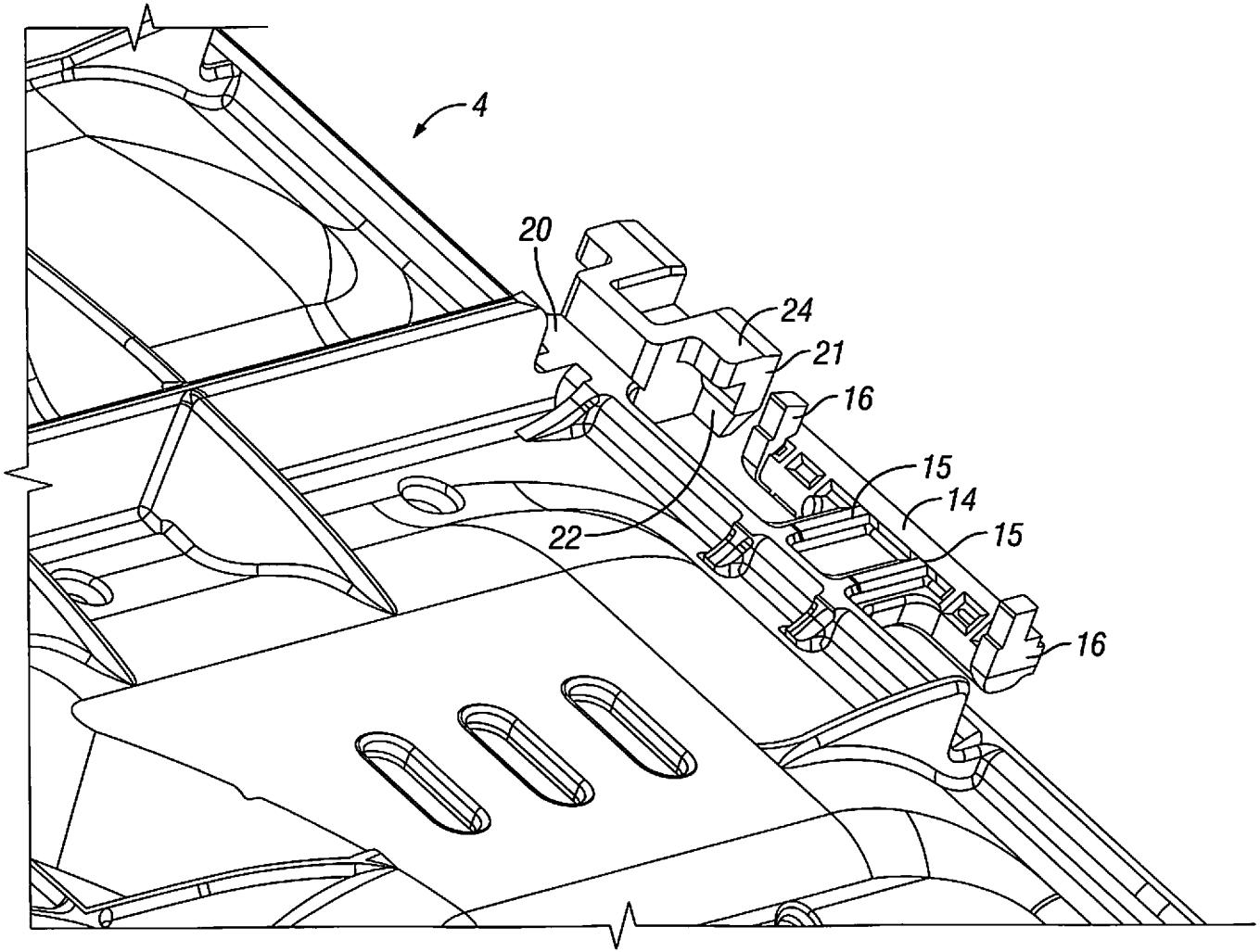
FIGS. 7 and 8 show a hinge connection and a support of a sidewall of the inventive container from two perspectives.
Figure 8:
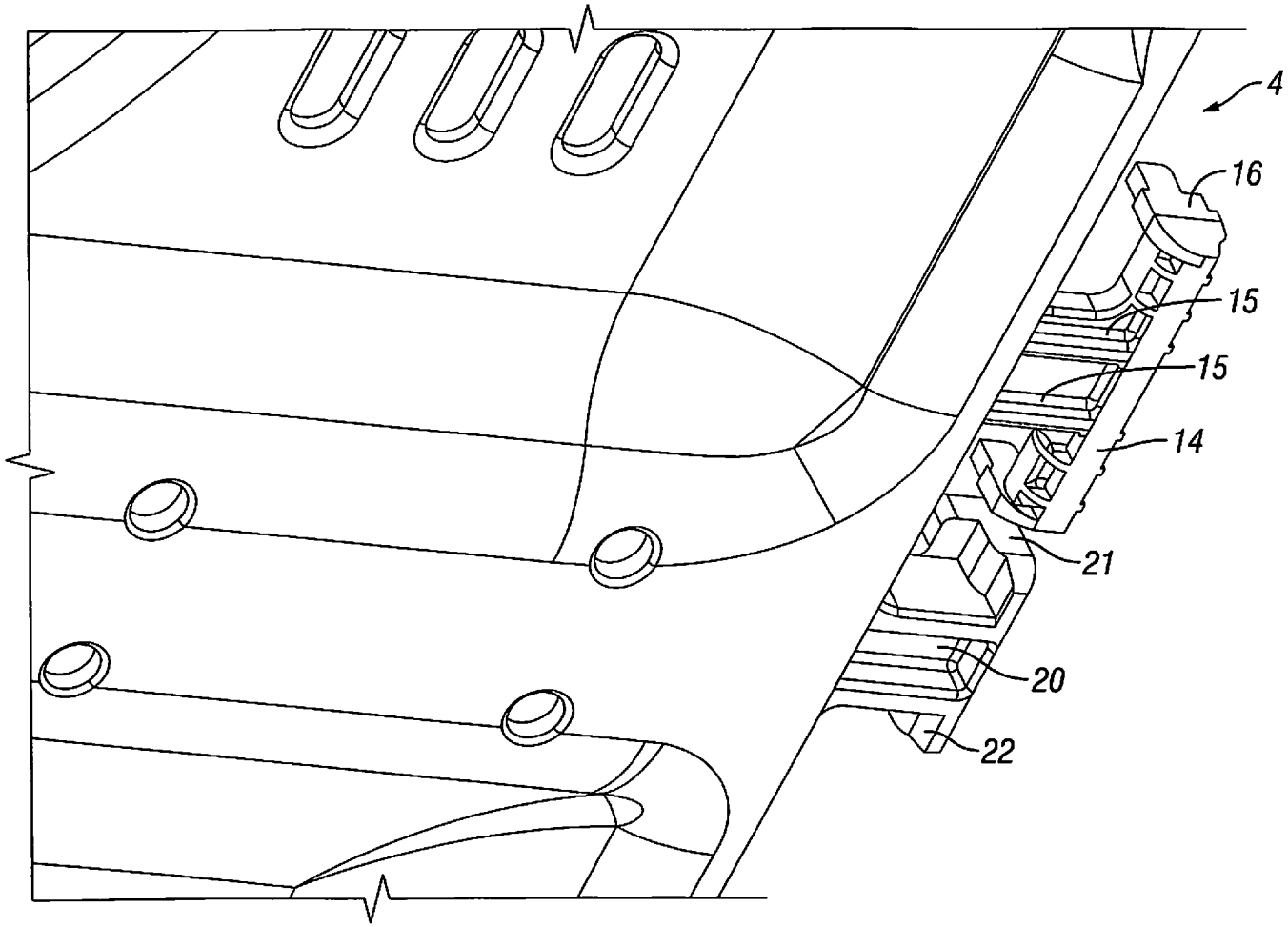
Figure 9:
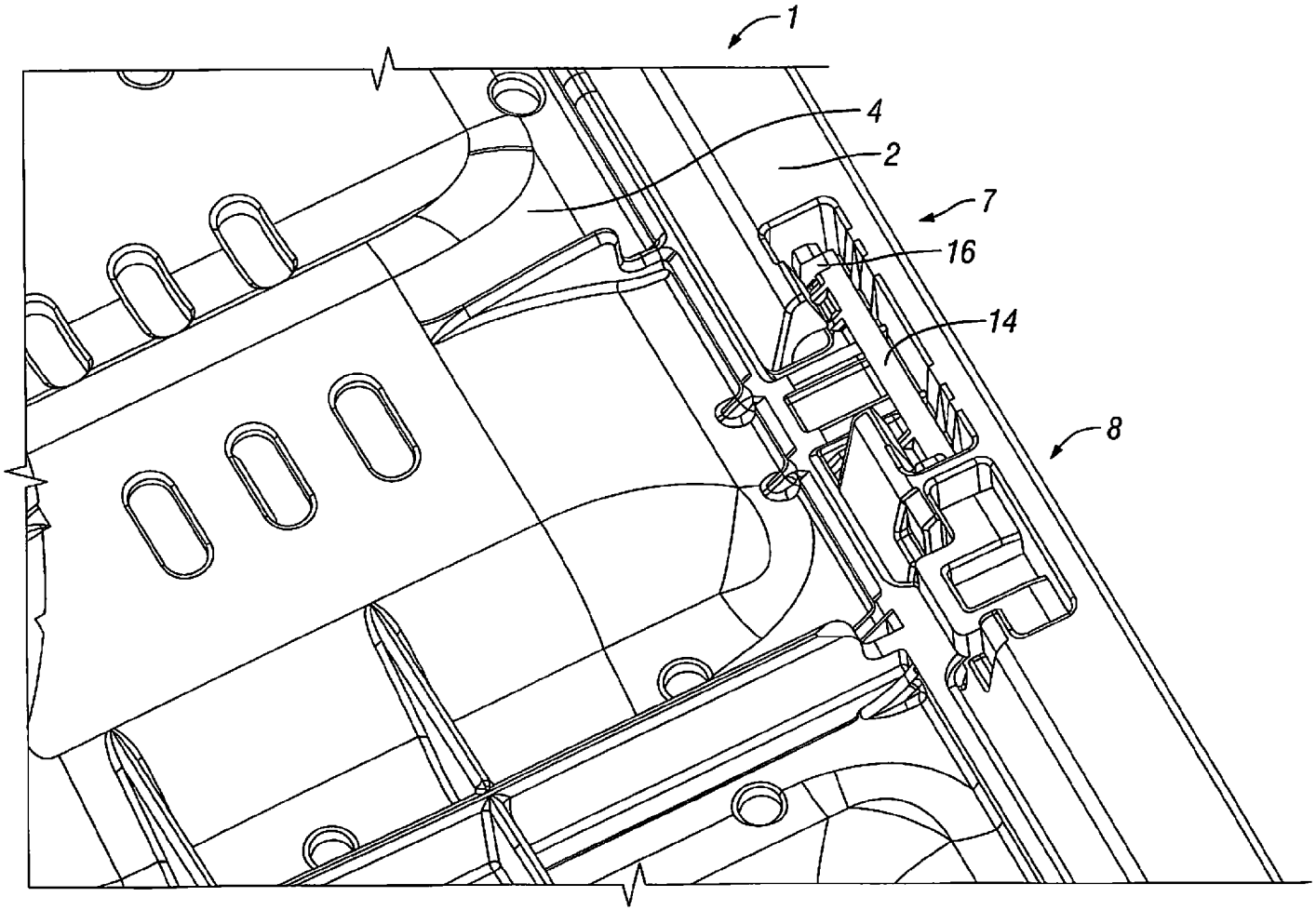
FIGS. 9 and 10 show the interaction of the sidewall and container base of the inventive container of FIG. 1 in two positions.
Figure 10:
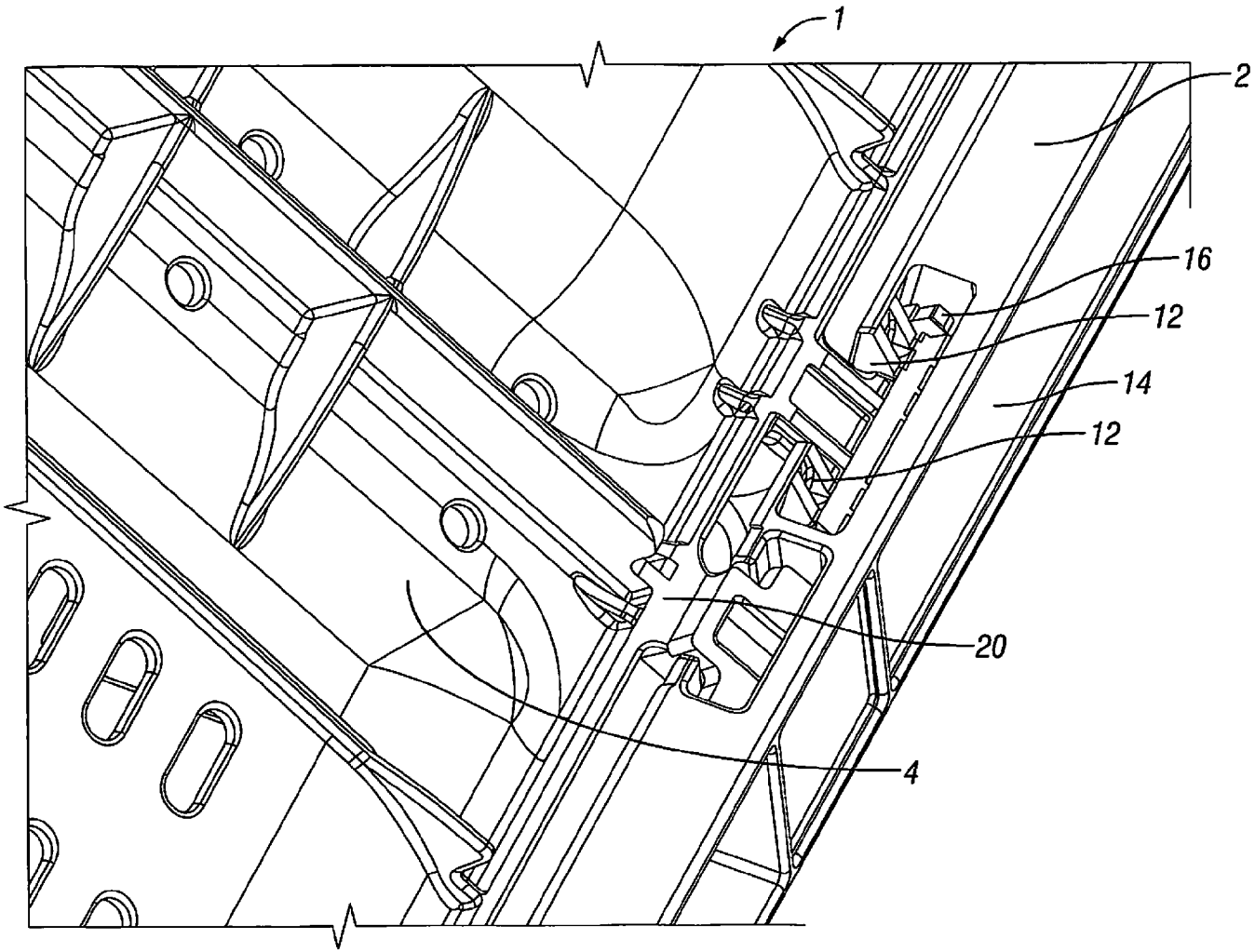

In connection with FIGS. 3*a-c* and FIGS. 4*a-c*, the shape and function of the hinge connection 7 and of the support 8 will be explained, said figures depicting sections through the hinge connection 7 and the support 8, respectively. The hinge connection 7 and the support 8 are visibly formed within a socket element 30, which is integrally formed with the base and constitutes part of the base element. The socket element 30 extends, on the side of the base, along sidewalls 4 and 6, as is apparent from FIG. 1. The socket element 30 projects upward above the bearing surface of the base element 2, and in the upright position of sidewalls 4 and 6, as is shown, in turn, in FIG. 1, it also forms part of the lateral boundary of the reception volume of the container, as it were. FIGS. 3*a* and 4*a* show the long sidewall 4, which is folded in toward the base 2. FIGS. 3*b* and 4*b* show an intermediate position, and FIGS. 3*c* and 4*c* show the fully upright position of the long sidewall 4 relative to the base 2. At the same time, reference shall also be made to FIGS. 5 to 10, which show detailed representations of the hinge connection 7 and of the support 8 separately for the container base and the long sidewall 4, as well as the interaction of the long sidewall 4 with the base 2 in two different positions, namely the fully folded-in position in FIG. 9, and an intermediate position in FIG. 10.

It can be seen that orifices 9, 10 are provided in the container base 2, both for the hinge connection 7 and for the support 8. The orifice 9 of the hinge connection 7 comprises insertion lugs 11*a*, 11*a*', 11*b*, 11*b*', 11*c*, 11*c*', 11*d*, 11*d*' that are oppositely arranged in pairs and are each provided with a slant, and which protrude inward in each case and taper in the upward direction toward the long sidewall 4. Protrusions 12, 13 are arranged in each case at the lower ends of the insertion lugs 11*a*, 11*a*', 11*b*, 11*b*', 11*c*, 11*e*', 11*d*, 11*d*'. A hinge pin 14 is integrally arranged, on the long sidewall 4, across two hinge pin ridges 15 that are apparent from FIG. 7. The hinge pin 14, in turn, comprises catch lugs 16 on its lateral ends, which catch lugs 16 extend, in relation to the extension of the long sidewall 4, in a direction perpendicular from the hinge pin 14. In this respect, FIG. 3*a* depicts a section through the hinge connection 7 at the level of the catch lug 16, and the sections of FIGS. 3*b* and 3*c* are made approximately at the level of the hinge pin ridges 15.

It may be seen from FIG. 3*a* that in the position of the long sidewall 4 folded down onto the base 2, the hinge pin 14 comprises a width A that is slightly wider than the clearance between the insertion lugs 11*a*, 11*a*', 11*b*, 11*b*', 11*c*, 11*c*', 11*d*, 11*d*' arranged in pairs. In connection with a certain flexibility of the plastic base 2 produced in an injection-molding process, the hinge pin 14 may be inserted into the orifice 9 along the insertion lugs 11*a*, 11*a*', 11*b*, 11*b*', 11*c*, 11*c*', 11*d*, 11*d*', and will engage, after a certain pressure is exerted, lock into place behind the protrusions 12, 13 arranged at the insertion lugs 11*a*, 11*a*', 11*b*, 11*b*', 11*c*, 11*c*', 11*d*, 11*d*', whereby the sidewall is protected from removal and is held. If needed, however, the sidewall may be lifted out again under pressure, so that replacement of walls is possible. As may be specifically seen from FIGS. 9 and 10, an opening 17 is provided in the base 2 at each orifice 9, said opening 17 receiving the hinge pin ridges 15 in the folded-down position of the long sidewall 4.

Due to the flexibility of the base 2 in the area of the orifice 9, the hinge pin 14 may be removed from the orifice 9 via the insertion lugs 11*a*, 11*a*', 11*b*, 11*b*', 11*c*, 11*c*', 11*d*, 11*d*' once the orifice 9 has been expanded due to elasticity. It becomes clear, in connection with FIGS. 3*b* and 3*c*, that the catch lugs 16 force the hinge pin 14 to perform an eccentric movement, upon the long sidewall 4 being folded out relative to the base 2, in that said hinge pin 14 presses against the side face 18 of the base 2. In this manner, the hinge pin 14 is forced to be positioned underneath the protrusion 12 of the insertion lugs 11*a*, 11*b*, 11*c*, 11*d* and is protected there, in the fully upright state of the long sidewall 4 relative to the base 2, against being pulled out in the direction of extension of the long sidewall 4. In this manner, no drifting of the base 2 relative to the long sidewall 4 will occur even with heavy loads bearing on the base 2, since the rigid protrusion 12 secures the long sidewall 4 in its position via the hinge pin ridges 15 and the hinge pin 14. The eccentric movement of the hinge pin 14 within the orifice 9 due to the catch lugs 16 becomes apparent, above all, from the top views in FIGS. 9 and 10. Since the hinge pin 14 is held via several adjacent protrusions 12 arranged on the insertion lugs 11*a*, 11*b*, 11*c*, 11*d*, tilting of the hinge pin 14 is ruled out, and a high level of stability of the hinge connection 7 is achieved.

The function of the support 8 will be explained below with reference to FIGS. 4*a*-*c* and FIGS. 5 to 10. One can recognize that the orifice 10 of the support 8 in the base 2 also comprises an opening 19 through which a support ridge 20 will engage in the folded-in state of the long sidewall 4 (FIGS. 7 and 10), said support ridge 20 having a support element 21 integrally formed thereon which comprises a hook-shaped profile. The hook-shaped profile of the support element 21 comprises a catch lug 22, which in the upright state of the long sidewall 4 acts against an oblique wall 23 in the container base 2 and thereby presses a flat surface element 24 of the support element 21 against an outer wall 23' within the base that acts as the corresponding surface element.

In this manner, as may specifically be visible in FIG. 4*c*, the sidewall is stabilized in its upright position, and in addition, it is prevented that the long sidewall 4 can be folded relative to the base 2 beyond the upright position. Also, in the upright state of the long sidewall 4, the catch lug 22 acts, opposite a protrusion 26 of the oblique wall 23 in the container base 2, as an additional attachment of the long sidewall 4 relative to the base 2, so that the support element 21 is prevented from being pulled out from the orifice 10. It is also in this manner that the base 2 is effectively prevented from drifting relative to the long sidewall 4 under heavy loads. In the upright position, therefore, the support is clamped in and reduces sharp bending of the rim of the base. This is advantageous, since with crates having a stackable rim, the rim of the base of the bottommost crate will usually slump under load, which may result in a sharp bend between the rim of the base and the sidewall, which would have a negative impact on the load application.

It is apparent specifically from FIG. 4*a* that the width B of the support element 21 is undersized, in relation to the clearance of the orifice 10, such that in the folded-in position of the long sidewall 4 relative to the base 2, the support element 21 may easily be inserted into and removed from the orifice 10.

One can also see in FIGS. 3*a* to 3*c* and FIGS. 5, 6 that an orifice ridge 25 is provided within the orifice 9 of the hinge connection 7, which orifice ridge 25 marks a lower boundary of the position of the hinge pin 14. For this reason, and also in connection with the boundary provided via the edges 27, 27', any rattling of the hinge connection 7 is prohibited, so that said hinge connection 7 appears very compact and stable.

Figure 11:
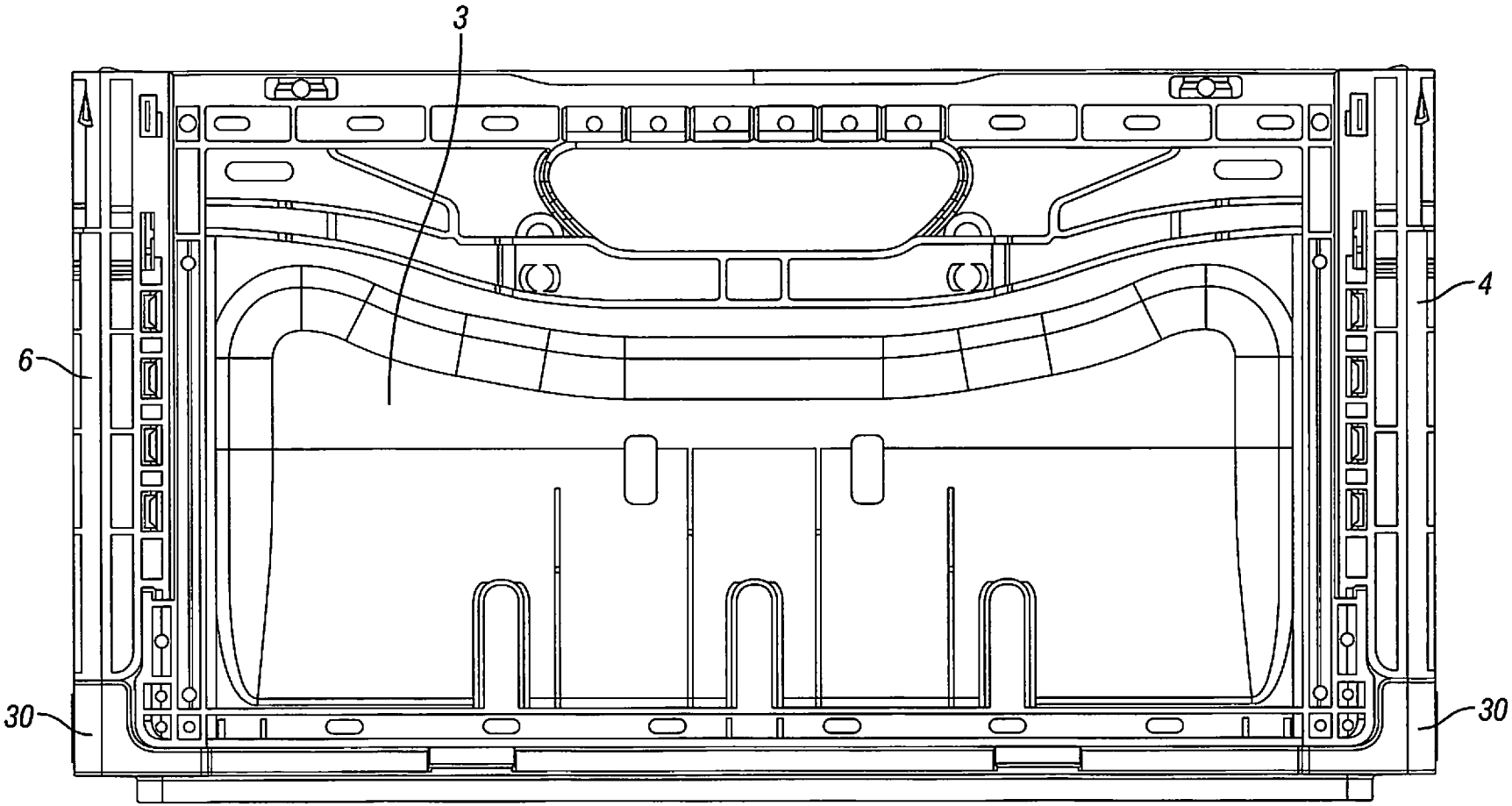
FIG. 11 shows a side view of the container as seen from the short sidewall.
Figure 12:
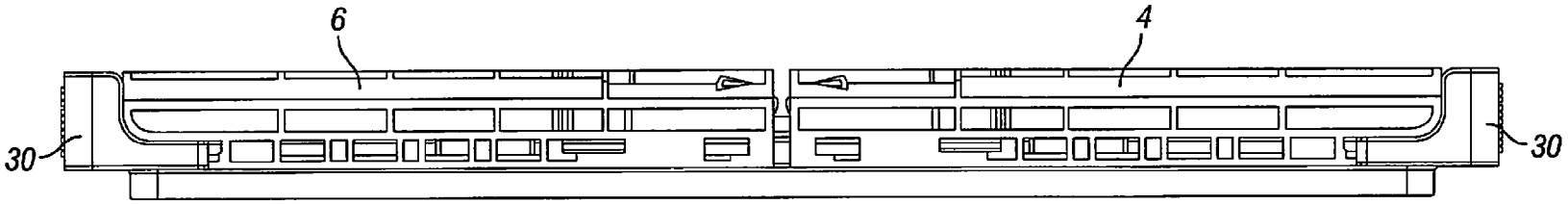
FIG. 12 shows a side view of the container, as seen from the short sidewall, in the folded-in position of the sidewalls.

FIG. 11 shows a side view of the container from the perspective of the short container side, and it is apparent that the short sidewall 3 is formed to be higher than the two adjacent long sidewalls 4 and 6. However, in the embodiment depicted, the top rims of the four sidewalls 3 to 6 are at the same level and, thus, flush at the top. This is achieved in that both sockets 30 that are formed on the base side project upward, beyond the base surface, to an accordingly high level. In this manner, the sidewalls 4 and 6 may be configured to have a shorter height, but to have a maximum height, at the same time, so that they may be folded down onto the base at the same level, as is shown in FIG. 12, without lying one on top of the other in the folded-down position and without therefore resulting in a comparatively high-level empties transport position. In this manner, an extremely planar folding position of the container is achieved, which in principle amounts to only the height of the base element and twice the thickness of the sidewalls. In accordance with a practical embodiment, the container depicted in the figures represents a crate having a basic dimension of 600×400 mm, and an overall height of 217 mm, which is achieved on account of the previously described hinge implementations. In this context, the "loose cage" within the socket, as was described with reference to FIGS. 3*a* to 4*c*, is also relevant, since due to the various positions, it may obtain the maximum height of the crate or an extremely low empty stacking height. Due to the configuration of the socket elements 30 projecting upward above the base, the sidewalls 4 and 6 may be folded out to have one length when the upper levels are the same, so that in the folded-in position, they are at the same level and do not have to overlap. By folding the sidewalls 4 and 6 upward, one eventually also achieves the height of the short sidewalls 3 and 5 due to the additional elevation resulting from the projecting lateral socket 30. As is shown in FIG. 12, the long sidewalls 4, 6 lie flat, and without any mutual overlap, on the short sidewall which are already folded directly onto the bearing surface of the base, and the empties transport position is determined essentially only by double the sidewall thickness, the thickness of the base and any contact members and stacking members that may be provided on the underside of the base and project downward.

It has become apparent from the previous representations that the inventive container 1 comprises a hinge connection 7 which almost entirely prevents the base 2 from slumping relative to the sidewall 3, 4, 5, 6 even under load. The hinge connection 7 may easily be implemented, in particular, such that the sidewall 3, 4, 5, 6 may be removed particularly easily from the base 2. In addition, a highly effective mechanical barrier against folding upward of the sidewall 3, 4, 5, 6 relative to the base 2 beyond the upright position may be realized in a simple manner. In this context, the container 1 may be produced in a particularly simple and inexpensive manner, since the base 2 may be produced, in an injection-molding process, without any slide in the tool, and since a simple tool arrangement is thus enabled.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A container, comprising:

a container base and at least two sidewalls that are foldable onto the container base, wherein the foldable sidewalls are articulated relative to the base by means of hinges, wherein the hinges comprise a hinge pin which in an upright position of the foldable sidewall is held, within an orifice in the container base that corresponds to the hinge pin, against being pulled out from the orifice, wherein at least one catch lug is provided which unilaterally protrudes from the hinge pin in the direction transverse to the alignment of the hinge pin, wherein the hinge pin is held within the orifice such that, when the sidewall is folded open, the catch lug acts on a wall of the orifice to cause an eccentric movement of the hinge pin in the orifice, wherein the hinge pin, in the folded-open position of the sidewall, is held within the orifice by at least one protrusion formed in the orifice, wherein the catch lug, in the folded-open position of the sidewall, acts on the wall of the orifice thereby fixing the hinge pin within the orifice underneath the protrusion, and wherein the sidewall comprises at least one support which interacts with the base and forms, in the upright position of the sidewall, a mechanical barrier against further folding-open of the sidewall.

2. The container as claimed in claim 1, wherein at least one insertion lug is provided within the orifice for clamp-like reception of the hinge pin within the orifice.

3. The container as claimed in claim 1, wherein the catch lug is integrally formed on the hinge pin, specifically in the orientation perpendicular to the extension of the sidewall, so that the hinge pin may be removed from the orifice in the position where the sidewall is folded onto the container base.

4. The container as claimed in claim 1, wherein the hinge pin is centrally attached to the sidewall by means of at least one hinge pin ridge, and in that two pairs of opposite and counteracting insertion lugs are configured within the orifice on either side of the hinge pin ridge(s).

5. The container as claimed in claim 4, wherein the protrusion holding the hinge pin is configured underneath at least two adjacent insertion lugs.

6. The container as claimed in claim 1, wherein the support is configured as a catch lug which, in the upright position of the sidewall, engages behind a protrusion of an oblique wall in the base.

7. The container as claimed in claim 1, wherein the support is configured as a surface element which, in the upright position of the sidewall, adjoins a corresponding surface element of the base, the surface elements being protected, in an upright position of the sidewall, against mutual displacement in the normal direction of the surface elements, and the two surface elements extending in the direction of extension of the upright sidewall.

* * * * *